US005299179A

United States Patent [19]

Miche et al.

[11] Patent Number: 5,299,179

[45] Date of Patent: Mar. 29, 1994

[54] PUSHPIECE FOR A DIVER'S TIMEPIECE

[75] Inventors: Marc-André Miche; Gérard Palix, both of Bienne, Switzerland

[73] Assignee: SMH Management Services AG, Biel, Switzerland

[21] Appl. No.: 8,293

[22] Filed: Jan. 25, 1993

[30] Foreign Application Priority Data

Feb. 7, 1992 [CH] Switzerland ..... 00355/92-3

[51] Int. Cl.[5] ..... G04B 3/04; G04B 37/10

[52] U.S. Cl. ..... 368/290; 368/288; 368/320

[58] Field of Search ..... 368/319-321, 368/290, 288

[56] References Cited

FOREIGN PATENT DOCUMENTS 229461 12/1941 Switzerland .
457291 2/1966 Switzerland .
802268 5/1968 Switzerland .

*Primary Examiner*—Bernard Roskoski
*Attorney, Agent, or Firm*—Griffin, Butler, Whisenhunt & Kurtossy

[57] ABSTRACT

This pushpiece (1) for a timepiece includes a movable head (3) slidingly mounted on a tube (4), said head partially enveloping such tube. The head exhibits a central cylindrical core (5) which penetrates into the tube, at least one O ring seal (6) being located between the tube and the core. A return spring (7) urges the head towards the exterior. The core (5) is extended by a stem (8), the diameter of which is greater than the diameter of the core, the spring being arranged between the stem and the tube. In this manner the spring is located in a sealed zone of the pushpiece and the mean diameter of the O ring seal is less than the mean diameter of the spring.

6 Claims, 1 Drawing Sheet

PUSHPIECE FOR A DIVER'S TIMEPIECE

The present invention relates to a pushpiece for a timepiece comprising a movable head slidingly mounted on a tube fixed to said timepiece, said head partially enveloping such tube and exhibiting a central cylindrical core penetrating into the tube, at least one O ring seal between the tube and the core and a helical return spring pushing the movable head back towards the exterior.

BACKGROUND OF THE INVENTION

Patent document CH-A-457 291 has already described a sealed pushpiece for a diver's watch comprising an axially movable part, slidingly mounted on a tube fixed to the body of the case, partially enveloping such tube and exhibiting a central core penetrating into the tube, at least one sealing element between the tube and the core and a return spring pushing the movable part back towards the exterior.

The same document indicates that in most sealed pushpieces mounted on diver's watches, it is necessary to use a return spring sufficiently powerful so that the pushpiece is not compressed by the heavy pressures prevailing at great diving depths. Such solution evidently has the disadvantage of requiring an excessively strong manual pressure on the pushpiece when the latter is operated out of the water or at small depth.

To overcome this difficulty, the pushpiece of the cited document proposes means permitting use of weaker springs for like depths or permitting attainment of greater depths with the present springs. The means indicated to arrive at such result consist in having the annular space comprised between the core and the enveloping part of the movable part communicate with the exterior of the pushpiece by a space left between the enveloping part and the tube and at the same time by at least one opening formed in the upper part of the enveloping part. Thus, during the dive, water penetrates easily into such annular space and the pressure of the water at the exterior of such space increases practically at the same time as the pressure of the water at the exterior of the pushpiece, and so relieves the return spring.

The means recommended hereinabove are however still insufficient to reduce the return force of the spring to a suitable value if the pushpiece must resist a very high hydrostatic pressure, for example that prevailing at a depth of 500 meters, which is to say according to ISO standard 6425, 50 bar (1 bar $=10^5$ Pa $=10^5$ N/m$^2$ $=0.1$ N/mm$^2$). This results from the fact that the cross-section of the central core of the movable part on which the hydrostatic pressure acts is relatively large, the section to be taken into account being that which is surrounded by the O ring seal. One can calculate the force F to which the spring must resist at pressure P if r is the radius of the core:

$$F(\mathrm{N})=\pi\cdot r^2(\mathrm{mm}^2)\cdot P(\mathrm{N/mm}^2)\cdot s \qquad (1)$$

in which s is a safety factor greater than 1, for example 1.25.

In known pushpieces, such as that of the cited document, the diameter of the core is on the order of 2 mm (from whence r = 1 mm). If such pushpiece must resist a pressure of 50 bar, the force of its return spring must be:

$$F(\mathrm{N})=\pi\cdot 1^2\cdot 5\cdot 1.25=19.6\ \mathrm{N}$$

which is the force which it will be necessary to exert on the pushpiece when the timepiece is out of the water. This force is considerable and difficult to accept. From whence the idea of the present invention to diminish the diameter of the core, thus to diminish the average diameter of the seal which surrounds it. This entails as corollary proposal a return spring the average diameter of which is greater than the average diameter of the seal since without such, the spring would not respect the design rule which requires that the average diameter of the spring be equal to or greater than 6 times the diameter of the wire. As here it concerns a diver's watch, one assumes as necessary fact that the return spring be located in a sealed zone of the pushpiece in order to avoid corrosion of such spring.

SUMMARY OF THE INVENTION

As a consequence thereof, the present invention is characterized by the fact that the central core is extended by a cylindrical stem the diameter of which is greater than the diameter of the core, the return spring being arranged between said cylindrical stem and said tube so that the spring is situated in a sealed zone of the pushpiece and that the average diameter of the O ring seal is smaller than the average diameter of the return spring.

The invention will now be understood upon reading the following description and from the drawing which illustrates it by way of example, in which two embodiments of the invention are described.

DESCRIPTION OF THE PREFERRED EMBODIMENTS

Figure 1:
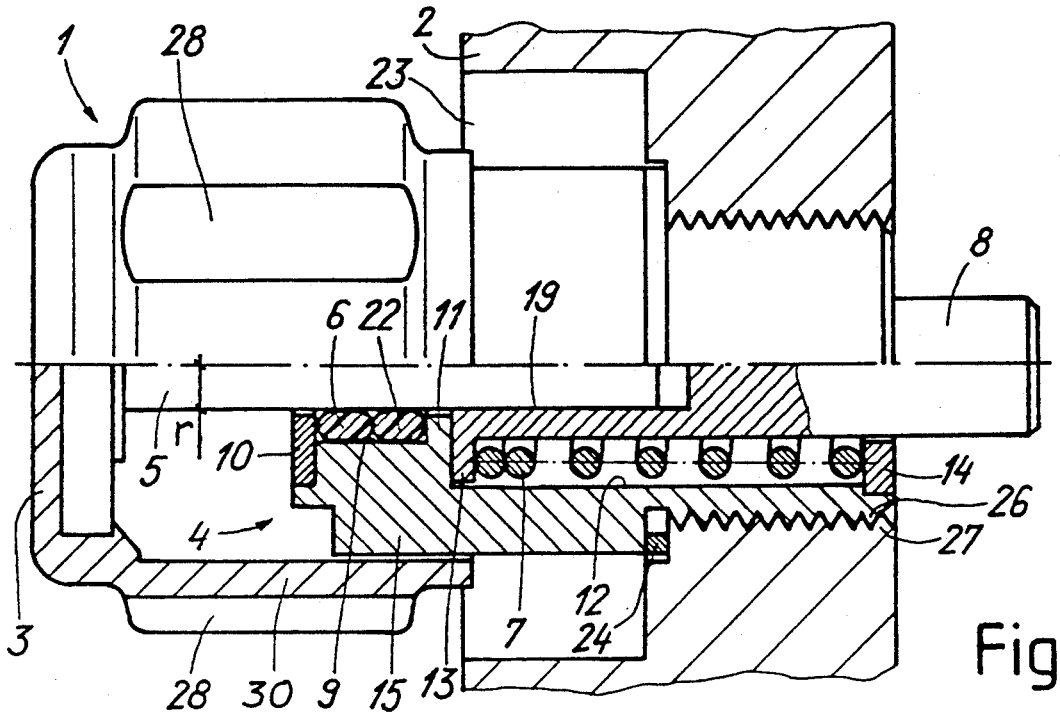
FIG. 1 shows a first embodiment of the invention, the pushpiece being shown in cross-section and in plan view in accordance with whether the left side and the right side of the figure are respectively considered
Figure 2:
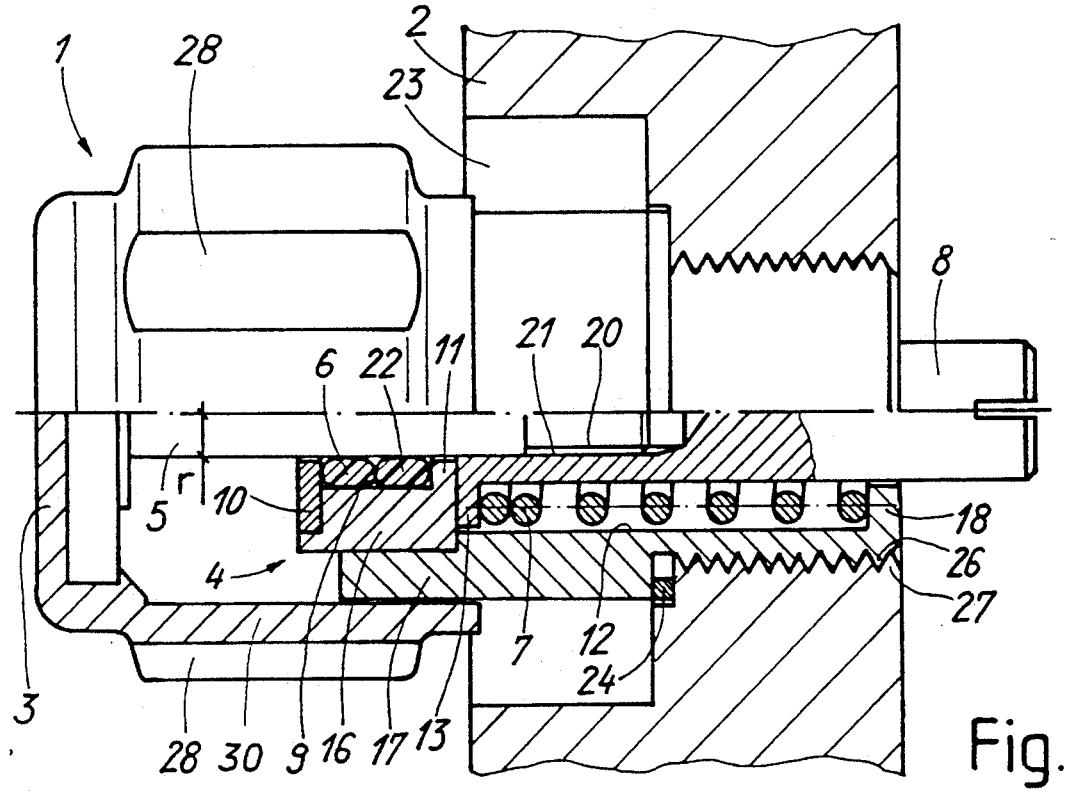
FIG. 2 shows a second embodiment of the invention, the pushpiece being shown according to the same criteria as those of FIG. 1.

The basic principle of the invention is apparent at the same time in FIGS. 1 and 2. In such figures pushpiece 1 includes a movable head 3 slidingly mounted on a tube 4 fixed to the timepiece, here represented by its caseband 2. In a known manner, tube 4 is screwed onto caseband 2. To this end, the lower end of the tube includes threading 26 screwed into the interior thread 27 formed in caseband 2. In order to assure sealing of tube 4 relative to the caseband 2, a seal 24 is interposed between a shoulder formed in the periphery of the tube and a housing provided in the caseband.

The figures show that head 3 partially envelops tube 4 by engagement of the skirt 30 exhibited by the head onto the upper end of the tube. Head 3 exhibits a central cylindrical core 5 of radius r and at least one O ring seal 6 between tube 4 and core 5. The pushpiece is completed by a helical return spring 7 which pushes the movable head back towards the exterior. When one presses on the head, spring 7 is compressed and skirt 30 penetrates partially into a housing 23 which has been formed in the caseband 2. Skirt 30 may be trimmed with fluting 28 in order to improve the appearance of the head.

According to a characteristic of the invention, FIGS. 1 and 2 show that the central core 5 is extended by a cylindrical stem 8 the diameter of which is greater than the diameter of the core, the return spring 7 being arranged between stem 8 and tube 4. This design enables immediate obtaining of the arrangement sought after and discussed in the introduction hereinabove, namely a return spring 7 located in a sealed zone of the pushpiece and an average diameter of the O ring 6 which is less than the average diameter of the return spring 7.

It is understood that the arrangement which has just been described enables diminishing the radius r of the central cylindrical core 5 and thence the force of the hydrostatic pressure acting on the pushpiece. If the formula (1) given hereinabove is taken up and if a core 5 the radius of which is 0.4 mm is used, the return force F of the spring will be found equal to $$F(N)=\pi\cdot 0.4^2\cdot 5\cdot 1.25=3.1\ N$$

the hydrostatic pressure P and the safety factor s being assumed to have the same values of 50 bar and 1.25.

Thus, for a total pressure of 50 bar, that is to say, a diving depth of 500 meters, the return force of the spring may be brought from 19.6 N to 3.1 N if the pushpiece of the present invention is applied. A force of 3.1 Newtons, which is that which the diver must exert at the surface, is entirely admissible and currently valid. There is no longer difficulty in manufacturing such a spring and to house it in the space which is available between stem 8 and tube 4.

There remains to be examined in detail the designs given by way of example on FIGS. 1 and 2.

FIG. 1 shows that tube 4 is formed as a single piece 15. The tube includes a first housing 9 in which is placed at least one O ring seal 6 (here an additional seal 22 is added thereto for safety reasons). Seals 6 and 22 are axially maintained in housing 9 by a first ring 10 assembled onto the tube and a first collar 11 integral with the tube. As far as the return spring 7 is concerned, this is axially maintained in a second housing 12 which is arranged below the first housing 9. Spring 7 is axially maintained in its housing 12 by a second collar 13 integral with the cylindrical stem 8 and a second ring 14 assembled below the tube. When the pushpiece is relaxed, which is the situation shown on FIG. 1, the second collar 13 bears against the first collar 11. It is further to be noted that the cylindrical stem is provided with a blind hole 19 into which is driven the end of core 5.

In order to assemble the pushpiece of FIG. 1, one begins by introducing seals 6 and 22 into housing 9. Next housing 9 is closed by means of ring 10 which is driven, crimped, glued or welded into a cup formed in tube 4. From below tube 4 there is introduced stem 8 on which is slid spring 7. Then the housing 12 is closed by means of ring 14 which one drives, crimps, welds or glues in a second cup formed in tube 4. Finally, as last operation, head 3 is put in place by driving its central core into the hole 19 of stem 8.

FIG. 2 shows that tube 4 is formed in two parts 16, 17 driven into one another. The first part 16 forms a stopper and includes a first housing 9 in which two seals 6 and 22 are placed. Such seals are axially maintained by a ring 10 assembled on the stopper and by a first collar 11 integrally formed with the stopper. The second part 17 forms the tube as such. It includes a second housing 12 which is arranged below the first housing 9 and in which is placed spring 7. The spring is axially maintained in its housing by a second collar 13 integral with stem 8 and a third collar 18 integrally formed of material below tube 17. As in FIG. 1, when the pushpiece is relaxed as shown on FIG. 2, the second collar 13 bears against the first collar 11. In the case of FIG. 2, core 5 is provided with threads 20 which are screwed into internal threading 21 formed in stem 8.

This design which differs slightly from that shown on FIG. 1 leads to a different assembly procedure of the pushpiece. One begins by introducing the O ring seals 6 and 22 into housing 9 of the stopper 16. Next the housing 9 is closed by means of ring 10 which is driven, crimped, glued or welded in a cup formed in the stopper 16. Stem 8 surrounded by spring 7 is introduced into tube 17. Stopper 16 is driven into tube 17. Finally, head 3 is screwed by its core 5 into stem 8.

With reference to FIG. 2, it will be noted that stopper 16 is entirely within tube 17. As a variant, one could have a stopper which caps the tube, the skirt of such stopper being then arranged between skirt 30 of head 3 and the periphery of tube 17.

What we claim is:

1. A pushpiece for a timepiece comprising a movable head slidingly mounted on a tube fixed to said timepiece, said head partially enveloping such tube and exhibiting a central cylindrical core penetrating into the tube, at least one O ring seal between the tube and the core and a helical return spring urging the movable head towards the exterior, the central core being extended by a cylindrical stem the diameter of which is greater than the diameter of the core, the return spring being arranged between said cylindrical stem and said tube in a manner such that the spring is located in a sealed zone of the pushpiece and the mean diameter of the O ring seal is less than the mean diameter of the return spring.

2. A pushpiece as set forth in claim 1 wherein the tube is formed as a single piece and includes a first housing in which the O ring seal is placed, such latter being axially maintained therein by a first ring mounted on the tube and a first collar integrally formed with the tube, and a second housing located below the first housing and in which the spring is placed, such latter being axially maintained therein by a second collar integrally formed with the cylindrical stem and a second ring mounted below the tube, said second collar bearing against said first collar when the pushpiece is relaxed.

3. A pushpiece as set forth in claim 1 wherein the tube is formed in two parts driven into one another, the first part forming a stopper and including a first housing in which the O ring seal is placed, such latter being axially maintained therein by a ring mounted on the stopper and a first collar integrally formed with the stopper, the second part forming the tube as such and including a second housing located below the first housing and in which the spring is placed, such latter being axially maintained therein by a second collar integrally formed with the cylindrical stem and a third collar integrally formed below the tube, said second collar bearing against said first collar when the pushpiece is relaxed.

4. A pushpiece as set forth in claim 1 wherein the cylindrical core is driven into a blind hole formed in the cylindrical stem.

5. A pushpiece as set forth in claim 1 wherein the cylindrical core is provided with a thread screwed into threading formed in the cylindrical stem.

6. A pushpiece as set forth in claim 1 which includes two O ring seals.

* * * * *